US010498072B2

(12) United States Patent
Hashimoto et al.

(10) Patent No.: US 10,498,072 B2
(45) Date of Patent: Dec. 3, 2019

(54) WATERPROOF CONNECTOR

(71) Applicant: Sumitomo Wiring Systems, Ltd., Yokkaichi, Mie (JP)

(72) Inventors: Norihito Hashimoto, Mie (JP); Hideto Nakamura, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/341,970

(22) PCT Filed: Sep. 29, 2017

(86) PCT No.: PCT/JP2017/035580
§ 371 (c)(1),
(2) Date: Apr. 15, 2019

(87) PCT Pub. No.: WO2018/074194
PCT Pub. Date: Apr. 26, 2018

(65) Prior Publication Data

US 2019/0245297 A1 Aug. 8, 2019

(30) Foreign Application Priority Data

Oct. 20, 2016 (JP) ..... 2016-205729

(51) Int. Cl.
*H01R 13/52* (2006.01)

(52) U.S. Cl.
CPC ..... *H01R 13/5219* (2013.01)

(58) Field of Classification Search
CPC ..... H01R 13/5219
USPC ..... 439/271, 383
See application file for complete search history.

(56) References Cited

U.S. PATENT DOCUMENTS 6,916,202 B2 * 7/2005 Maue ..... H01R 13/5219 439/587
7,104,831 B2 * 9/2006 Fukatsu ..... H01R 13/4364 439/385
7,311,546 B2 * 12/2007 Itou ..... H01R 13/4364 439/385
7,491,081 B2 * 2/2009 Fehling ..... H01R 13/622 439/277

(Continued)

FOREIGN PATENT DOCUMENTS

JP 2006-216133 8/2006
JP 2007-80737 3/2007

(Continued)

OTHER PUBLICATIONS

International Search Report dated Oct. 31, 2017.

*Primary Examiner* — Neil Abrams
(74) *Attorney, Agent, or Firm* — Gerald E. Hespos; Michael J. Porco; Matthew T. Hespos

(57) ABSTRACT

A butting surface (6) is formed on a tip of the receptacle (2) of a male connector (M), and a smooth sealing surface (10) is formed on a back side via a tapered surface (7, 9). A pad (5) to be butted in a compressed state by the butting surface (6) when the male connector and a female connector (M, F) are connected is mounted in a back part of a terminal accommodating portion (13) of the female connector (F). A seal body (14) separate from the pad (5) and held in close contact with the sealing surface (10) in a watertight manner is mounted in front of the pad (5) in the terminal accommodating portion (13).

4 Claims, 4 Drawing Sheets

(56) References Cited

U.S. PATENT DOCUMENTS

| | | | | |
|---|---|---|---|---|
| 7,553,186 | B2 * | 6/2009 | Morikawa | H01R 13/5208 439/587 |
| 7,641,502 | B2 * | 1/2010 | Itou | H01R 13/4364 439/383 |
| 7,722,381 | B2 * | 5/2010 | Hiramatsu | H01R 13/4362 439/385 |
| 9,379,483 | B2 * | 6/2016 | Suzuki | H01R 13/629 |
| 9,559,459 | B2 * | 1/2017 | Jozwik | H01R 13/622 |
| 10,367,292 | B2 * | 7/2019 | Furuya | H01R 13/5202 |
| 2003/0166359 | A1 | 9/2003 | Maue et al. | |
| 2007/0059967 | A1 | 3/2007 | Itou | |
| 2015/0137756 | A1 | 5/2015 | Fukushima et al. | |
| 2019/0245297 | A1 * | 8/2019 | Hashimoto | H01R 13/52 |

FOREIGN PATENT DOCUMENTS

| | | |
|---|---|---|
| JP | 2010-218857 | 9/2010 |
| WO | 2015/154747 | 10/2015 |

* cited by examiner

WATERPROOF CONNECTOR

BACKGROUND

Field of the Invention

The invention relates to a waterproof connector.

Related Art

Japanese Unexamined Patent Publication No. 2007-80737 discloses a waterproof connector where a housing of a male connector is formed with a receptacle. On the other hand, a housing of a female connector includes a terminal accommodating portion and an outer tube surrounding the terminal accommodating portion. The receptacle of the male connector is fittable between the terminal accommodating portion and the outer tube. A waterproof seal made of rubber is formed into a ring shape and is fit in a back part of the terminal accommodating portion.

The waterproof seal is composed of a seal portion formed with seal lips on a side surface and a pad protruding out on the rear end of the seal. When the male and female connectors are connected, the seal lips of the seal are held in close contact with the inner peripheral surface of the receptacle in a watertight manner, thereby providing sealing between the male and female connectors. Further, the tip of the receptacle butts against the pad portion to suppress the rattling of the male and female connectors in a connecting direction.

In the conventional case, a part of the receptacle that closely contacts the seal lips is somewhat back of the tip of the receptacle. A close-contact part of the inner peripheral surface of the receptacle with the seal lips may be a smooth polished surface to ensure sealability. Such a polished surface may be scratched when being touched by external matter (fingers or the like), and sealability may be reduced. As a countermeasure against that, it is considered to set the close-contact part with the seal lips in a back part maximally distant from an opening edge of the receptacle. In the case of adopting such a countermeasure, a possible waterproof seal is formed such that a pad and a portion formed with seal lips are spaced apart a large distance in a front-rear direction. More specifically, the seal pad and the portion formed with the seal lips are coupled via a coupling portion long in the front-rear direction. However, if the coupling portion is long, the coupling portion is easily buckled when the waterproof seal is mounted by being pushed, thereby presenting a problem of making a mounting operation difficult.

The present invention was completed on the basis of the above situation and aims to provide a waterproof connector enabling a sealed location of a receptacle to be protected and a seal component and the like to be mounted easily.

SUMMARY

The invention is directed to a waterproof connector with a male connector including a male housing having a male terminal fitting accommodated therein. A receptacle is formed on the male housing and is open forward. A butting surface is formed on an opening end surface of the receptacle, and a tapered surface is formed in an area of an inner peripheral surface of the receptacle backward of the butting surface and is expanded forward. A sealing surface is formed in an area of the inner peripheral surface of the receptacle backward of the tapered surface. The connector further has a female connector including a female housing with a terminal accommodating portion configured to accommodate a female terminal fitting. An outer tube of the female housing surrounds the terminal accommodating portions. A fitting space is formed between the terminal accommodating portion and the outer tube portion and is open toward a leading end of the female housing so that the receptacle can fit therein. An annular pad member made of rubber is mounted in a back part of the terminal accommodating portion and is configured to be butted in a compressed state by the butting surface of the receptacle when the male and female housings are connected. A seal body member made of rubber is formed separately from the pad and is fit on an outer peripheral surface of the terminal accommodating portion at a position spaced forward from the pad. The seal body is configured to be held in close contact with the sealing surface of the receptacle in a sealed state when the male and female housings are connected.

According to the present invention, the pad and the seal body member are configured separately and can be spaced wide apart in a front-rear direction. Thus, the sealing surface can be set in a more backward part in the receptacle of the male housing, which contributes to the protection of the sealing surface. Further, since the pad and the seal body member can be mounted separately into the terminal accommodating portion, a mounting operation can be performed easily performed.

Front and back sides of the pad may be shaped symmetrically. If the pad and the seal body are integrated as before, there is no possibility that a worker erroneously inserts the pad and the seal body with the front and back sides thereof inverted. However, if the pad is a single member as in the present invention, the above possibility arises. Accordingly, if the front and back sides of the pad member are shaped symmetrically, as described above, the pad member can be mounted properly regardless of front or back orientation.

Front and back sides of the seal body may be shaped symmetrically. If the front and back sides of the seal body member also are shaped symmetrically, the seal body member can be mounted into the terminal accommodating portion regardless of front or back orientation.

DETAILED DESCRIPTION

Next, a specific embodiment of a waterproof connector of the present invention is described with reference to the drawings. The waterproof connector is composed of a male connector M and a female connector F that are connected to and separated from each other by being relatively displaced in a front-rear direction.

Figure 2:
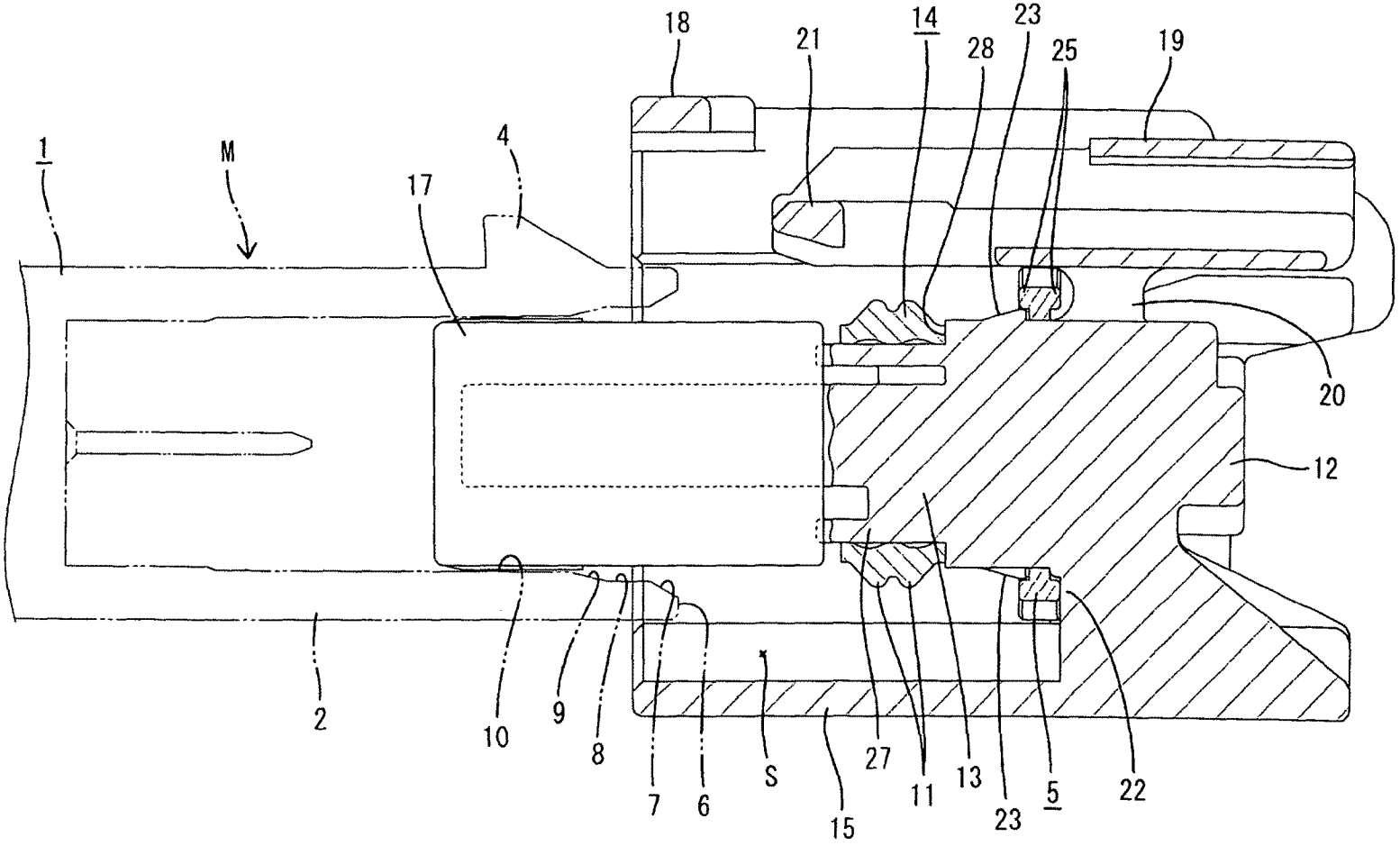
FIG. 2 is a section along A-A of FIG. 1 showing a state where male and female connectors are lightly connected.

A male housing 1 constituting the male connector M includes a receptacle 2 substantially in the form of a rectangular tube open forward as shown in FIG. 2 and the like. Male tabs 3 of a plurality of male terminal fittings are provided in parallel inside the receptacle 2. Further, a lock projection 4 is formed in a widthwise central part near an opening edge of the upper surface of the receptacle 2.

A butting surface 6 to be butted against a pad 5 to be described later is formed upright substantially at a right angle to a connecting direction of the male and female connectors M, F on a tip surface of the receptacle 2. Further, a first tapered surface 7 expanded forward is formed over the entire periphery on an opening edge part of the inner peripheral surface of the receptacle 2, i.e. in an area backward of the butting surface 6.

A parallel peripheral surface 8 parallel to the connecting direction of the male and female connectors M, F is formed in an area of the inner peripheral surface of the receptacle 2 backward of the first tapered surface 7, i.e. in an area connected to a back end of the first tapered surface 7. A second tapered surface 9 expanded forward is formed in an area of the inner peripheral surface of the receptacle 2 backward of the parallel peripheral surface 8, i.e. in an area connected to a back end of the parallel peripheral surface 8.

A sealing surface 10 is formed in an area of the inner peripheral surface of the receptacle 2 backward of the second tapered surface 9, i.e. in an area connected to a back end of the second tapered surface 9. The sealing surface 10 can be held in close contact with seal lips 11 of a seal body 14 on the side of the female connector F to be described later. This sealing surface 10 is a polished surface parallel to the connecting direction of the male and female connectors M, F and smoothly polished. The sealing surface 10 is formed in a range slightly wider than at least a formation range of the seal lips 11 in the front-rear direction, and formed substantially into a strip over the entire periphery in a circumferential direction of the receptacle 2.

The female connector F includes a female housing 12, the pad 5 and the seal body 14. The female housing 12 is composed of a terminal accommodating portion 13 for accommodating female terminal fittings (not shown) and an outer tube 15 substantially surrounding this terminal accommodating portion 13. A fitting space S is formed between the terminal accommodating portion 13 and the outer tube 15 and is open on a leading end side of the female housing 12 for receiving the receptacle 2 of the male housing 1.

Figure 1:
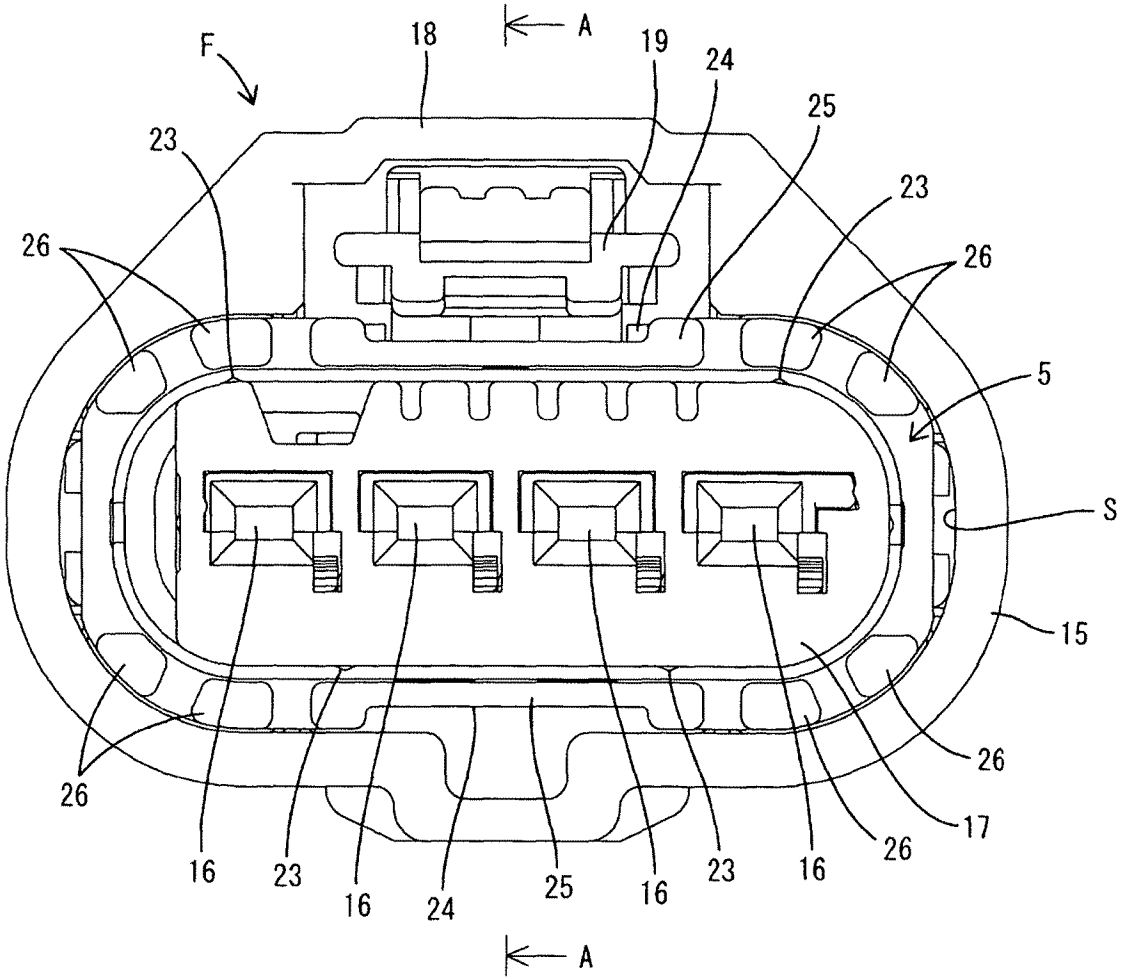
FIG. 1 is a front view of a waterproof connector.
Figure 3:
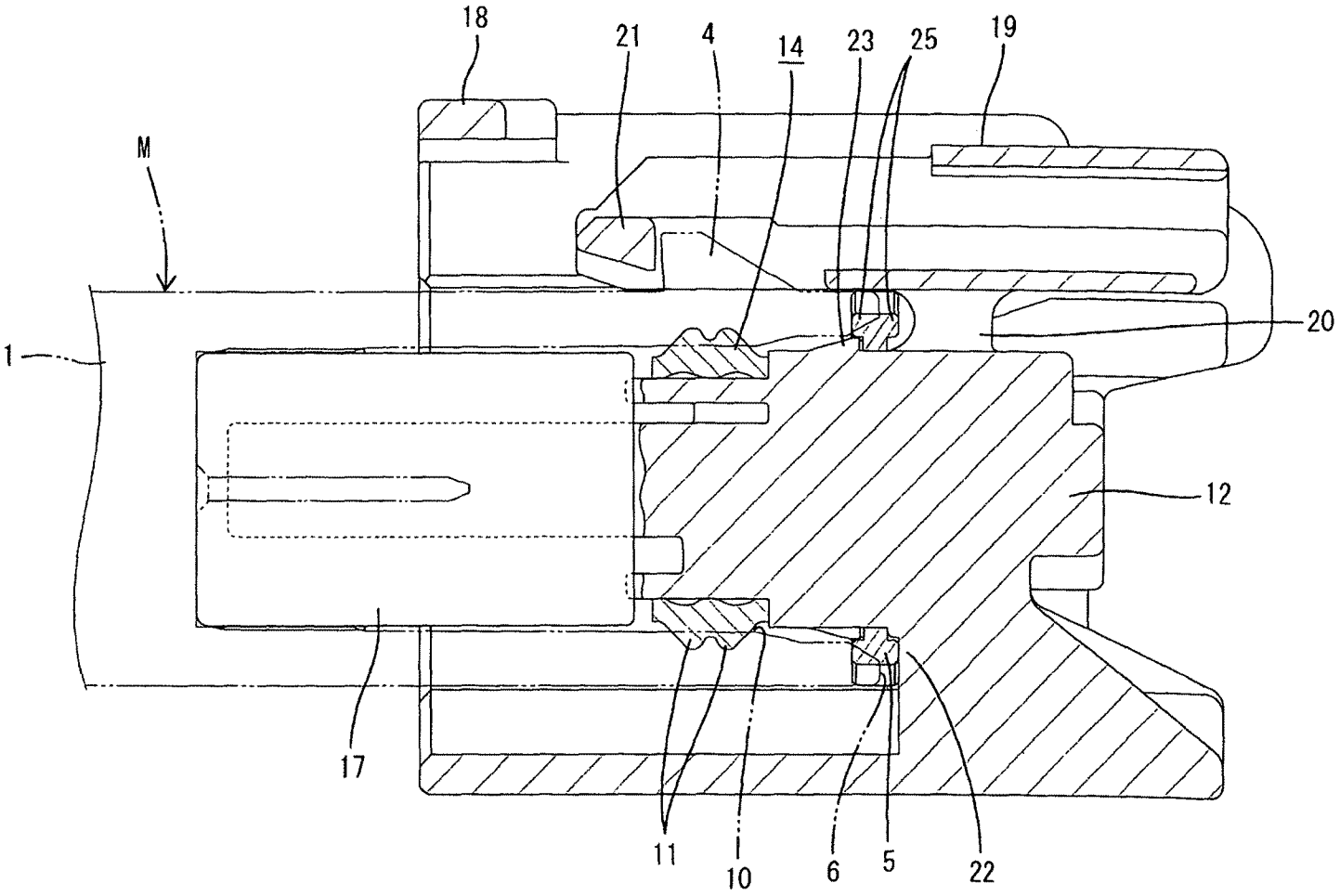
FIG. 3 is a section along A-A of FIG. 1 showing a state where the male and female connectors are properly connected.

As shown in FIG. 1, the terminal accommodating portion 13 is provided with four cavities 16 arranged in a width direction. Each cavity 16 penetrates through the terminal accommodating portion 13 in the front-rear direction, and the unillustrated female terminal fitting is accommodated in a sealed state inside each cavity 16. A retainer 17 is mounted into a front part of the terminal accommodating portion 13 for retaining the female terminal fittings and retaining the seal bod 14 to be described later. As shown in FIG. 3, the retainer 17 projects forward from the outer tube 15 with the retainer 17 mounted in the terminal accommodating portion 13. Note that windows communicating with the respective cavities 16 are open in the retainer 17.

An upper part of the outer tube 15 is open upward except at a front end part. Open parts of a front end are coupled by a connecting piece 18. A lock arm 19 is formed on the upper surface of the terminal accommodating portion 13 and at a location where the outer tube 15 is open. A supporting leg 20 is formed in a central part in a length direction on the lower surface of the lock arm 19, and is coupled to a rear part of the terminal accommodating portion 13. The lock arm 19 extends forward and rearward from the supporting leg 20. The lock arm 19 is resiliently vertically displaceable in a seesaw manner with the supporting leg 20 as a support.

A lock portion 21 is formed on the tip of the lock arm 19. The lock arm 19 is deflected and deformed to ride on the lock projection 4 on the side of the male connector M in the process of connecting the male and female connectors M, F, and moves over the lock projection 4 and resiliently returns as the connection is completed. When the connection of the male and female connectors M, F is completed, the lock portion 21 and the lock projection 4 are locked, with the result that the male and female connectors M, F are locked in a connected state.

Figure 4:
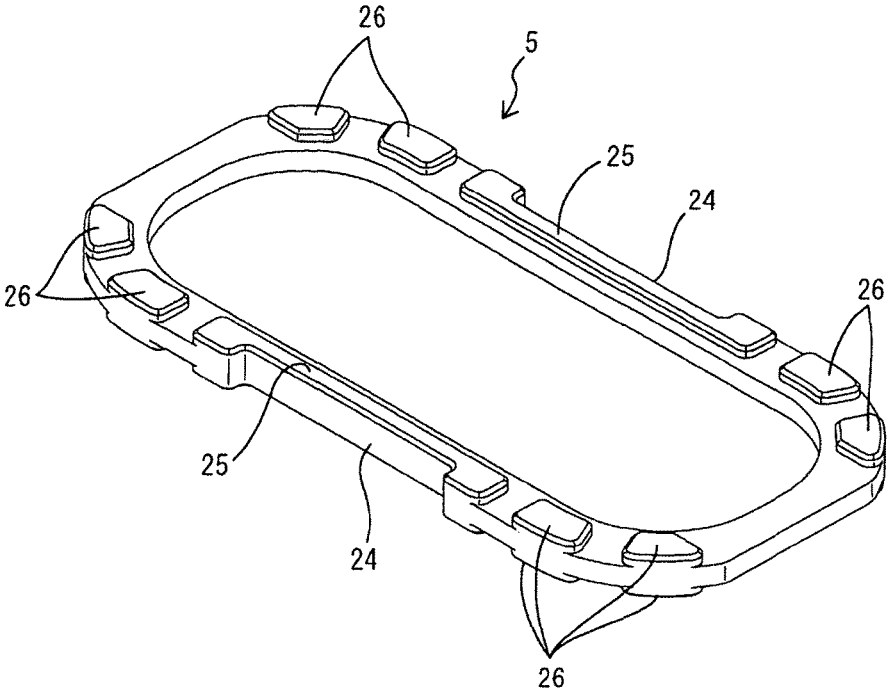
FIG. 4 is a perspective view showing a pad member.

The pad 5, as shown in FIG. 4, is disposed in a back part of the terminal accommodating portion 13. The pad 5 is formed of a rubber material into a substantially elliptical flat ring. The pad 5 constitutes the female connector F by being held in close contact with and fit to the outer peripheral surface of the terminal accommodating portion 13. A part of the pad 5 is in contact with a back wall 22 of the female housing 12. Retaining projections 23 project at plural positions on the outer peripheral surface of the terminal accommodating portion 13 and slightly forward of the back wall 22. The retaining projections 23 are locked to the front surface of the pad 5 to retain the pad 5.

The pad 5 is shaped so that front and back (front and rear) sides and upper and lower sides are symmetrical, and is mountable into the terminal accommodating portion 13 even if the front and back (front and rear) sides and the upper and lower sides are inverted. Escaping recesses 24 are formed in central parts of both long side parts on both front and back surfaces of the pad 5. As shown in FIG. 1, these escaping recesses 24 are formed to be somewhat wider than a width of a lower surface side of the lock arm 19, so that interference with the lock arm 19 can be avoided when a tip side of the lock arm 19 is inclined downward.

As shown in FIG. 4, a plurality of butting projections 25, 26 project on the both front and back surfaces of the pad 5. The butting projections 25, 26 are arranged symmetrically on the front and back sides and the upper and lower sides of the pad 5. Among the respective butting projections 25, 26, those formed at positions corresponding to the escaping recesses 24 (long butting projections 25) are longer than the other butting projections (short butting projections 26), and formed to straddle the escaping recesses 24.

The short butting projections 26 are disposed at positions across the long butting projections 25 in the width direction and at corner parts of the pad 5. When the male and female connectors M, F are connected properly, as shown in FIG. 3, the butting surface 6 on the tip of the receptacle 2 is butted against any of the butting projections 25, 26 and the pad 5 is sandwiched between the butting surface 6 and the back end surface of the terminal accommodating portion 13 to be resiliently deformed in a compressing direction (front-rear direction). By this resilient deformation of the pad 5, the rattling of the male and female connectors M, F in the front-rear direction is restricted.

The seal body 14 is made of rubber separately from the pad 5 is mounted on the outer peripheral surface of the terminal accommodating portion 13. The seal body 14 constitutes the female connector F by being disposed at a position spaced forward from the pad 5 on the outer periphery of the terminal accommodating portion 13. As shown in FIG. 3, a mounting portion 27 for mounting the seal body 14 is formed in an area of the outer surface of the terminal accommodating portion 13 in front of a position where the retaining projections 23 are formed.

The mounting portion 27 is smaller than a side backward thereof to form a step. The seal body 14 is fit to the mounting portion 27, and the rear end of the seal body 14 is pressed against a step surface 28. A retainer 17 is mounted in front of the seal body 14, and the rear end surface of this retainer 17 faces the front surface of the seal body 14 to retain the seal body 14.

The seal body 14 has a ring shape that confirms to the outer periphery of the terminal accommodating portion 13.

Two front and rear seal lips 11 are formed on the outer peripheral surface of the seal body 14. The seal lips 11 project over the entire periphery. When the male and female connectors M, F are connected properly, the seal lips 11 are compressed and deformed by the sealing surface 10 of the receptacle 2 in the male connector M. In this way, sealing is provided between the male and female connectors M, F. Similar to the pad 5, the seal body 14 also is shaped so that front and back sides and upper and lower sides are symmetrical, and can be mounted properly even if the front and back sides and the upper and lower sides of the pad 5 are inverted with respect to the mounting portion of the terminal accommodating portion 13.

Next, functions and effects of the waterproof connector of this embodiment configured as described above are described. In this embodiment, since the pad 5 and the seal body 14 are produced as separate components unlike conventional waterproof connectors, these are separately mounted into the female housing 12. The pad 5 is fit from front and pushed straight rearward before the retainer 17 is mounted into the terminal accommodating portion 13. The pad 5 is retained by moving over the respective retaining projections 23 and being locked to the respective retaining projections 23. A back surface of the retained pad 5 is in contact with the back wall 22.

Subsequently, the seal body 14 is fit into the terminal accommodating portion 13 from front and pushed straight rearward. At this time, the seal body 14 is fit while being somewhat expanded and deformed and the back surface of the seal body 14 is held in contact with the step surface 28. Thereafter, when the retainer 17 is mounted into the front part of the terminal accommodating portion 13, the rear surface of the retainer 17 faces the front end surface of the seal body 14, thereby retaining the seal body 14. Note that an operation of inserting the female terminal fitting into each cavity 16 is performed before the retainer 17 is mounted at a proper position. When the retainer 17 is mounted at the proper position after the insertion, the female terminal fittings are properly retained.

After the female connector F is assembled in this way, the male and female connectors M, F are connected. Specifically, as shown in FIG. 2, the receptacle 2 is fit into the fitting space S via the retainer 17. At this time, since the male and female connectors M, F are guided to align centers thereof by the first and second tapered surfaces 7, 9, smooth connection is possible. As the connection proceeds, the lock portion 21 of the lock arm 19 rides on the lock projection 4 of the receptacle 2. At this time, the lock arm 19 resiliently swings about the supporting leg 20.

When the female connector F and the male connector M are connected properly, the lock portion 21 passes through the lock projection 4 so that the lock arm 19 resiliently returns. When the lock arm 19 resiliently returns, the lock projection 4 and the lock portion 21 are locked so that the male and female connectors M, F are locked in the properly connected state.

As shown in FIG. 3, with the male and female connectors M, F properly connected, the butting surface 6 of the receptacle 2 is butted against the respective butting projections 25, 26 of the pad 5 to resiliently compress the respective butting projections 25, 26. Thus, the rattling of the male and female connectors M, F in the front-rear direction is restricted. Therefore, even if vibration of a vehicle is transmitted to the male and female connectors M, F, fine sliding movements of the male and female terminal fittings in the front-rear direction can be suppressed and the wear of contact points can be effectively avoided.

Further, in the properly connected state, the sealing surface 10 of the receptacle 2 is resiliently held in close contact with the seal lips 11 of the seal body 14, thereby providing waterproofing between the peripheral surfaces of the male and female connectors M, C.

In this embodiment, the sealing surface 10 is provided on the inner peripheral surface of the receptacle 2 from the tip side successively via the first tapered surface 7, the parallel peripheral surface 8 and the second tapered surface 9. Accordingly, the sealing surface 10 is disposed at a more backward position of the receptacle 2 than before. In this way, a situation where the sealing surface 10 is scratched by external matters can be effectively avoided.

As described above, the pad 5 and the seal body 14 are spaced apart farther in the front-rear direction as the sealing surface 10 and the butting surface 6 are spaced apart a large amount in the front-rear direction. If a mode of a seal component in which the pad 5 and the seal body 14 are integrated as before is considered, the pad 5 and the seal body 14 are connected via a long coupling piece.

However, in such a mode, if the seal component is mounted into the terminal accommodating portion 13, the coupling piece weak in stiffness is buckled and a mounting operation may become difficult. In this respect, if the seal component is composed of two separate components, i.e. the pad 5 and the seal body 14 as in this embodiment, these can be individually mounted into the terminal accommodating portion 13. Thus, there is no possibility of buckling during the mounting operation and the operation can be smoothly performed.

Further, in the case of a seal component having an integral structure as before, the seal component may be dragged by a friction force with the receptacle 2 and entirely detached in separating the male and female connectors M, F. However, in this embodiment, at least the pad 5 is maintained at a mounting position and is not detached together with the seal body 14.

Furthermore, in the case of a separate configuration, there is a concern for erroneous mounting in an orientation inverted from a proper orientation. However, since the front and back sides and the upper and lower sides of both the seal body 14 and the pad 5 are symmetrical in this embodiment, the seal body 14 and the pad 5 can be mounted properly in either orientation and usability is improved.

The invention is not limited to the above described and illustrated embodiment. For example, the following embodiments also are included in the scope of the invention.

Although the plurality of butting projections 25, 26 are formed on the pad member 5 in the above embodiment, the pad may be a flat plate having no butting projection.

Although the first tapered surface 7 and the second tapered surface 9 are separated in the front-rear direction and formed in two stages in the area forward of the sealing surface 10 on the inner peripheral surface of the receptacle 2 in the above embodiment, only one tapered surface may be provided.

LIST OF REFERENCE SIGNS

1 . . . male housing
2 . . . receptacle
3 . . . male tab (male terminal fitting)
5 . . . pad member
6 . . . butting surface
7 . . . first tapered surface
9 . . . second tapered surface
10 . . . sealing surface

13 . . . terminal accommodating portion
14 . . . seal body member
15 . . . outer tube portion
F . . . female connector
M . . . male connector
S . . . fitting space

The invention claimed is:

1. A waterproof connector, comprising:

a male connector including a male housing having a male terminal fitting accommodated therein;

a receptacle formed on the male housing and open forward;

a butting surface formed on an opening end surface of the receptacle;

a tapered surface formed in an area of an inner peripheral surface of the receptacle backward of the butting surface and expanded forward;

a sealing surface formed in an area of the inner peripheral surface of the receptacle backward of the tapered surface;

a female connector including a female housing;

a terminal accommodating portion constituting the female housing and configured to accommodate a female terminal fitting;

an outer tube portion constituting the female housing and surrounding the terminal accommodating portions;

a fitting space formed between the terminal accommodating portion and the outer tube portion, open toward a leading end side of the female housing and allowing the receptacle to be fit thereinto;

a pad made of rubber, having an annular shape, constituting the female connector by being mounted in a back part of the terminal accommodating portion and configured to be sandwiched between a back wall of the female housing and the butting surface of the receptacle to be resiliently deformed in a compressed state when the male and female housings are connected;

a plurality of butting projections formed on the pad and configured to be butted against the butting surface of the receptacle when the male and female housings are connected; and a seal body made of rubber, formed separately from the pad, constituting the female connector by being fit on an outer peripheral surface of the terminal accommodating portion at a position spaced forward from the pad and configured to be held in close contact with the sealing surface of the receptacle in a sealed state when the male and female housings are connected.

2. The waterproof connector of claim 1, wherein front and back sides of the pad are shaped symmetrically.

3. The waterproof connector of claim 2, wherein front and back sides of the seal body are shaped symmetrically.

4. The waterproof connector of claim 1, wherein front and back sides of the seal body are shaped symmetrically.

* * * * *